United States Patent [19]

Sugarman et al.

[11] 4,443,005

[45] Apr. 17, 1984

[54] FOOT SUPPORT DEVICE

[75] Inventors: Edward D. Sugarman, 6726 Gleason Pl., Fayetteville, N.Y. 13066; Alan W. Brownlie, Skaneateles, N.Y.

[73] Assignee: Edward D. Sugarman, Fayetteville, N.Y.

[21] Appl. No.: 416,098

[22] Filed: Sep. 9, 1982

[51] Int. Cl.[3] ..... A61G 13/00

[52] U.S. Cl. ..... 269/328

[58] Field of Search ..... 269/328, 325, 75, 203; 5/443, 444; 128/84 R, 84 B, 85, 80 R, 133, 134

[56] References Cited

U.S. PATENT DOCUMENTS

| | | | |
|---|---|---|---|
| 661,488 | 11/1900 | Broadbooks | 269/203 |
| 1,516,795 | 11/1924 | Schwarting | 269/328 |
| 1,576,781 | 3/1926 | Philips | 128/84 B |
| 2,027,795 | 1/1936 | Stephenson | 128/84 B |
| 2,057,992 | 10/1936 | Wiruth | 269/328 |
| 2,067,891 | 1/1937 | Comper | 269/328 |
| 2,446,930 | 8/1948 | Hower | 269/328 |
| 2,820,455 | 1/1958 | Hall | 128/87 B |
| 3,020,909 | 2/1962 | Stevens | 128/84 R |
| 3,745,996 | 7/1973 | Rush | 128/84 B |

FOREIGN PATENT DOCUMENTS

| | | | |
|---|---|---|---|
| 193523 | 12/1906 | Fed. Rep. of Germany | 128/84 B |

*Primary Examiner*—Robert C. Watson

*Attorney, Agent, or Firm*—Bruns & Jenney

[57] ABSTRACT

A device for mechanically supporting a patient's foot in such a manner that surgery can be performed on the tibia or ankle without the need for medical personnel to hold the leg. In addition, a fracture can be reduced, held, X-rayed and casted by the surgeon without help. The foot support device permits the reduction of tibial and ankle fractures slowly, thereby avoiding muscle spasm, and holds the reduced fracture in place for casting. The support device also substantially eliminates the problem of controlling a heavy leg during surgery or trauma treatment.

9 Claims, 5 Drawing Figures

FOOT SUPPORT DEVICE

RELATED APPLICATION

This application is related to copending application Ser. No. 264,081 filed May 15, 1981 by Edward D. Sugarman now U.S. Pat. No. 4,428,571 for Limb Positioning Device. The foot support device disclosed herein is particularly adapted for use with a portion of the device disclosed in the copending application as will become apparent from the following description.

BACKGROUND OF THE INVENTION

The present invention relates generally to surgical appliances, and has particular reference to a novel foot support or holding device for use with an operating table.

When operating on a tibia or ankle, it is presently necessary to have one or two people hold the leg during surgery. Similarly, this kind of help is needed in the reduction of fractures and in casting. With medical costs constantly increasing, it is obvious that eliminating the need for the additional medical personnel would be very desirable and that there exists a need for reliable mechanical means to perform the holding function heretofore done by medical personnel.

SUMMARY OF THE INVENTION

The device of the invention is adapted to mechanically support a patient's foot in such a manner that surgery can be performed on the tibia or ankle without the need for people to hold the leg. In addition, a fracture can be reduced, held, X-rayed and casted by the surgeon without help.

The foot support device of the invention permits the reduction of tibial and ankle fractures slowly, thereby avoiding muscle spasm, and holds the reduced fracture in place for casting. The device also permits the reduction to be carried out and checked by X-ray before casting without fear of losing the reduction. Finally, the support device substantially eliminates the problem of controlling a heavy leg during surgery or trauma treatment.

Since the foot support device enables a reduction in medical personnel when the procedures discussed above are being performed, it will be apparent that the cost of the medical care can be reduced.

While the support or holding device of the invention is described herein with particular reference to the foot, it will be apparent as the description proceeds that it can also be used advantageously for a hand or an arm.

DESCRIPTION OF THE PREFERRED EMBODIMENT

Figure 1:
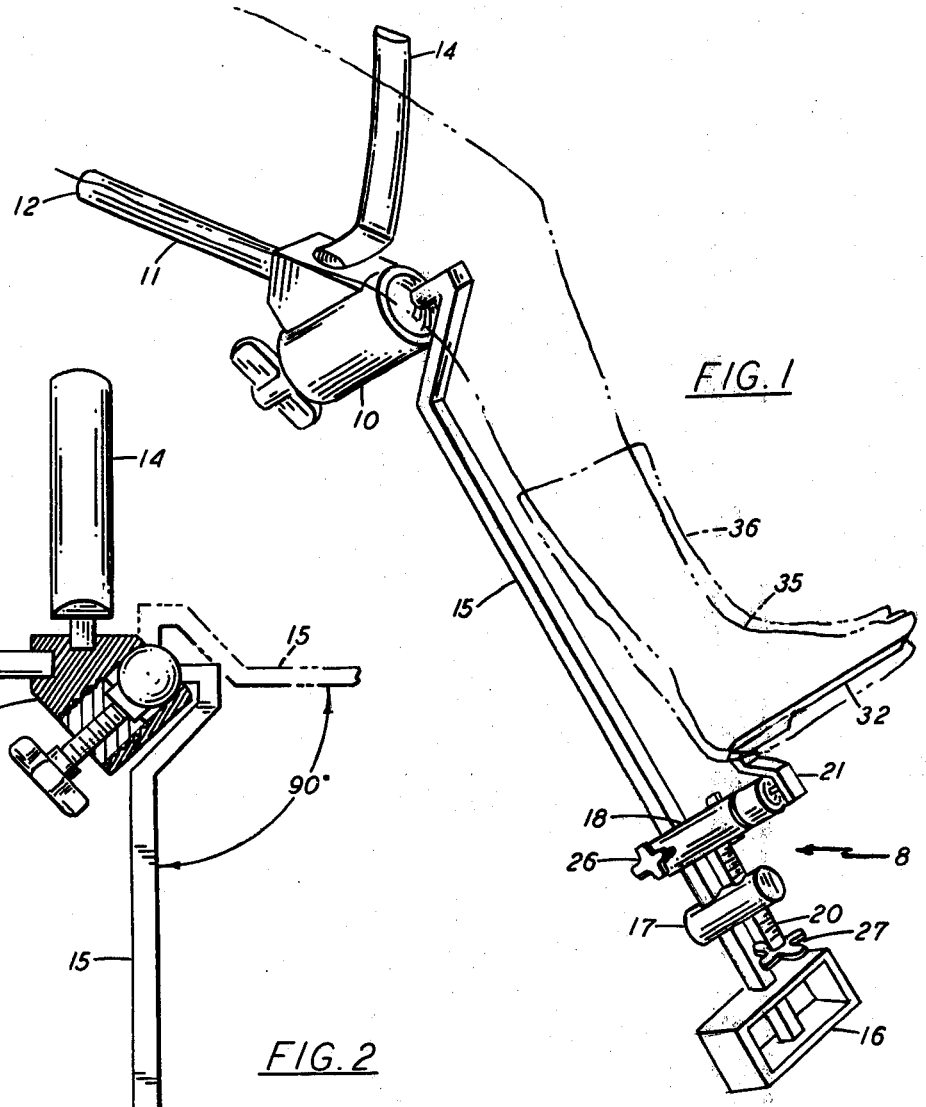
FIG. 1 is a perspective view of a foot support device embodying the invention, a portion of the patient's leg being shown in phantom lines.
Figure 2:
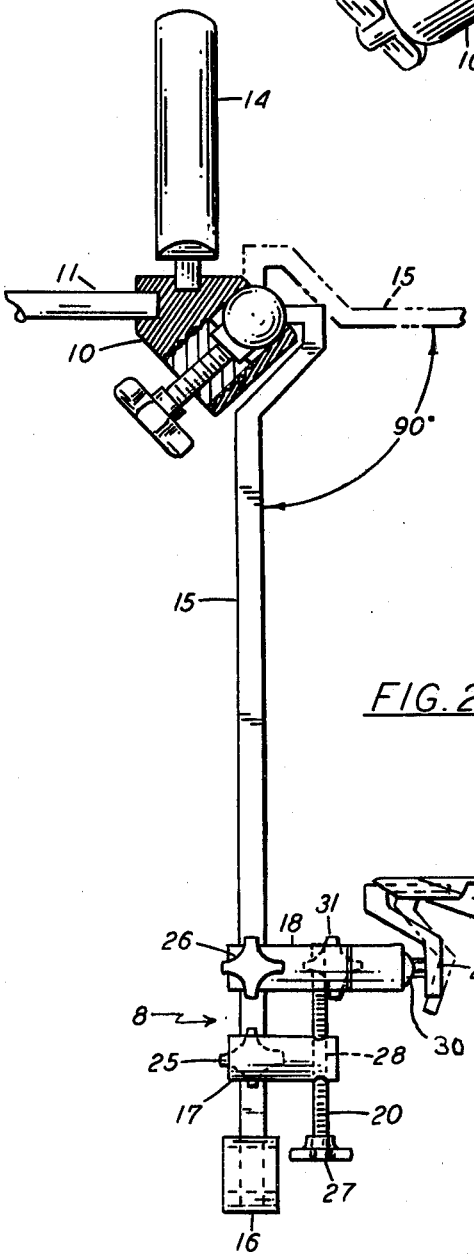
FIG. 2 is a side elevation of the device of FIG. 1 with a portion shown in section to illustrate details of the construction.

Having reference now to the drawings, and with particular reference to FIGS. 1 and 2, the foot support device of the invention is generally indicated at 8 and is mounted on an elongated extension member 15 that is a part of the limb positioning device disclosed in copending application Ser. No. 264,081, supra. The limb positioning device includes a central support member 10 and a rod 11 that is rigidly secured to the support and extends outwardly therefrom as shown. The free end 12 of the rod is adapted to be firmly clamped in a standard fitting (not shown) on the operating table with which the limb positioning and foot support devices are being used. Alternatively, the rod can be supported by an independent support means.

The limb positioning device also includes an upstanding limb engaging member 14 that is pivotally mounted on the central support member 10. All of the limb positioning components and the foot support device 8 are fabricated from stainless steel so that they are autoclavable. In this connection, a handle 16 is provided on the outer end of the extension member 15 so that the angular position of the latter can be adjusted without destroying the sterile condition of the limb positioning and foot support devices.

Figure 4:
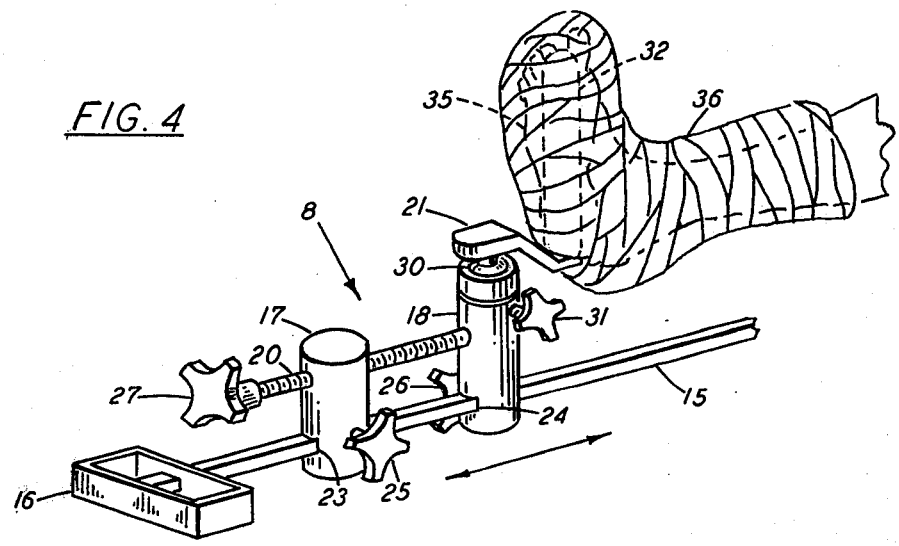
FIG. 4 is a perspective view of the foot engaging and positioning portion of the device as applied to a lower leg and foot to which a cast has been applied.
Figure 3:
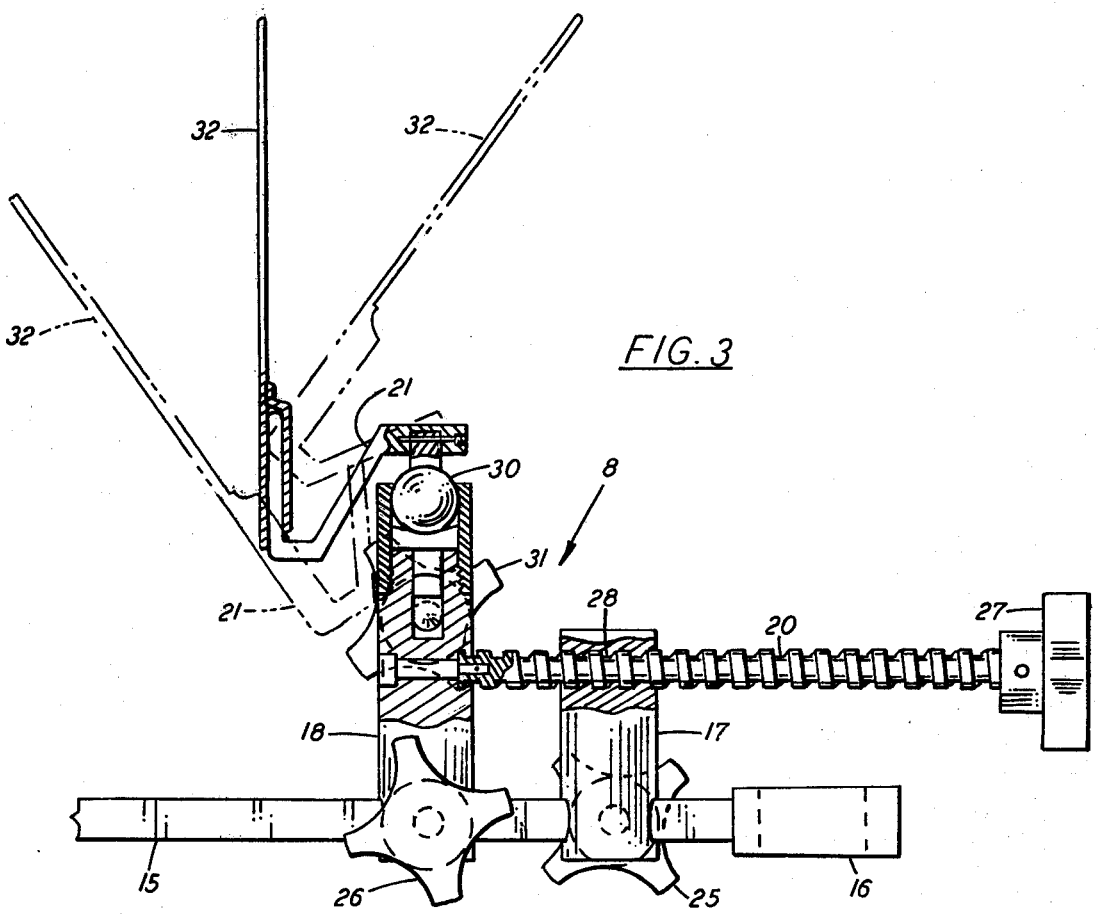
FIG. 3 is an enlarged side elevation of the foot engaging and positioning portion of the device with parts shown in section to illustrate details of the construction.

The foot support device 8 is essentially comprised of a pair of generally cylindrical posts 17 and 18 slidably mounted on the extension member 15, a lead screw or thread 20 that connects the posts together and a foot engaging plate 21 mounted at the upper end of post 18 so as to be angularly adjustable with respect thereto, see FIGS. 2 and 3. In the embodiment of the invention shown, extension member 15 has a square cross section and the posts 17 and 18 are provided with conforming diametrical passageways 23 and 24, FIG. 4, near their lower ends through which the extension member passes with a sliding fit. Posts 17 and 18 are also provided with suitable locking knobs 25 and 26, respectively, which operate to hold the posts in any desired position of adjustment along the extension member.

The lead screw 20 is fixed at its inner end to the post 18, FIG. 3, although it can rotate relative thereto. At its outer end the screw 20 is provided with a turning knob 27, and in between the post 18 and knob 27 the screw passes through a conforming threaded passageway 28 adjacent the upper end of post 17. With this arrangement, the posts can be moved in unison along the extension member 15 or the post 17 can be locked in position on the member and the post 18 can be moved relative to post 17 by turning the knob 27 as will be described in more detail hereinafter.

Figure 5:
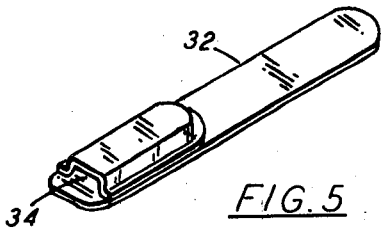
FIG. 5 is a top perspective view of a disposable cover plate that is employed in conjunction with the foot engaging plate of the invention.

The foot engaging plate 21 is connected to post 18 by a ball joint 30 which permits the position of the plate to be angularly adjusted relative to the post as indicated in FIG. 3. Suitable means actuated by a locking knob 31 are provided to secure the plate 21 in a desired position of angular adjustment. As best shown in FIG. 3, the configuration of plate 21 is such that it can be moved through a required range of positions without having its movement limited by the adjacent structure. The foot engaging plate 21 is adapted to coact with a disposable cover plate 32, FIGS. 2, 3 and 5, the cover plate having a pocket 34 in which the free end of plate 21 is received as shown.

In using the foot support device 8, the locking knobs 25,26 and 31 are initially loose and the lead screw is positioned so that post 17 is at the approximate midpoint of the screw, FIGS. 1 and 2. The device is then moved as a whole along extension member 15 until the foot engaging plate 21 and its disposable cover 32 just contact the patient's foot shown in phantom lines at 35 in FIG. 1. With the bottom of the patient's foot in contact with the disposable cover, the angular position of the latter is adjusted to place the foot in the position desired by the surgeon for the work to be performed. Thereafter, locking knob 31 is tightened to hold the plate 21 and cover 32 in the desired position and the foot is maintained in contact with the cover by means of strip padding or straps (not shown).

After locking knob 31 has been tightened, the locking knob 25 for post 17 is tightened and the post thus becomes the anchor for the foot support device on the extension member 15. If further longitudinal movement of post 18 is required for precise positioning of the patient's foot, this can be accomplished by turning the lead screw knob 27 to move post 18 closer to or farther away from the anchor post 17, this in effect being a final, vernier adjustment. After the final adjustment by means of knob 27, the locking knob 26 for post 18 is tightened whereby the foot is securely held in the desired position.

With the foot securely held as above described, the surgeon can proceed with surgery on the tibia or ankle without the need for additional medical personnel to hold the leg. In the event that the patient has a fracture that must be reduced, the procedure set forth above is followed up through the step of tightening locking knob 25 so that post 17 becomes the anchor. Thereafter, the lead screw knob 27 can be turned to slowly move post 18 towards post 17 whereby reduction of the fracture can be effected. Following the reduction, the locking knob 26 for post 18 is tightened to hold the reduction which can then be varied by X-ray and casted, all without the need for additional personnel. In applying a cast as shown at 36 in FIGS. 1 and 4, the disposable cover 32 is incorporated in the cast which is then disengaged from the foot engaging plate 21.

From the foregoing description it will be apparent that the invention provides a novel and very advantageous medical device which should enable medical costs to be reduced. As will be understood by those familiar with the art, the invention may be embodied in other specific forms without departing from the spirit or essential characteristics thereof.

We claim:

1. In a limb positioning device adapted for use with an operating table, the device including a central support member, means for detachably securing the support member to the operating table, and an extension member movably connected to the support member, the improvement comprising a foot holding unit having coacting first and second post members slidably mounted on the extension member, means interconnecting the post members whereby they can be moved in unison along the extension member, locking means on the first post member for securing it in a desired position of longitudinal adjustment on the extension member, a foot engaging plate mounted on the second post member so as to be angularly adjustable with respect thereto, and locking means on the second post member for securing the foot engaging plate in a desired position of angular adjustment, the post interconnecting means permitting fine adjustment of the longitudinal position of the second post member on the extension member relative to the position of the first post member.

2. A foot holding unit as defined in claim 1 wherein the means interconnecting the post members is an elongated lead screw, the screw having a turning knob at one end and being connected to the second post member at its other end, the lead screw being in threaded engagement with the first post member in between its ends whereby turning the knob operates to move the second post member closer to or farther away from the first post member.

3. A foot holding unit as defined in claim 2 together with a second locking means on the second post member for securing the latter in position on the extension member after its longitudinal position has been adjusted by turning the lead screw knob.

4. A foot holding unit as defined in claim 1 wherein the foot engaging plate is movably connected to the second post member by a ball joint.

5. A foot holding unit as defined in claim 1 together with a disposable cover plate for the foot engaging plate.

6. In a limb positioning device adapted for use with an operating table, the device including a central support member, means for detachably securing the support member to the operating table, a limb engaging member mounted on the support member, and an extension member in the form of an elongated rod movably connected to the support member, the improvement comprising a foot holding unit having coacting first and second post members slidably mounted on the extension member, means adjustably interconnecting the post members whereby they can be moved in unison along the extension member, locking means on the first post member for securing it in a desired position of longitudinal adjustment of the extension member, a foot engaging plate mounted on the second post member so as to be angularly adjustable with respect thereto, a first locking means on the second post member for securing the foot engaging plate in a desired position of angular adjustment, the post interconnecting means permitting fine adjustment of the longitudinal position of the second post member on the extension member relative to the position of the first post member, and a second locking means on the second post member for locking it in its adjusted position on the extension member.

7. A foot holding unit as defined in claim 6 wherein the means interconnecting the post members is an elongated lead screw, the screw having a turning knob at one end and being connected to the second post member at its other end, the lead screw being in threaded engagement with the first post member in between its ends whereby turning the knob operates to move the second post member closer to or farther away from the first post member.

8. A foot holding unit as defined in claim 6 wherein the foot engaging plate is movably connected to the second post member by a ball joint.

9. A foot holding unit as defined in claim 6 together with a disposable cover plate for the foot engaging plate.

* * * * *